US007294065B2

(12) United States Patent
Liang et al.

(10) Patent No.: US 7,294,065 B2
(45) Date of Patent: Nov. 13, 2007

(54) WEIGHT ASSEMBLY FOR GOLF CLUB HEAD

(75) Inventors: Ming-Ching Liang, Tainan (TW); Chen-Lung Chien, Taoyuan (TW); Hsing-Cheng Tsai, Taoyuan (TW)

(73) Assignee: Fu Sheng Industrial Co., Ltd., Taipei (TW)

( * ) Notice: Subject to any disclaimer, the term of this patent is extended or adjusted under 35 U.S.C. 154(b) by 291 days.

(21) Appl. No.: 11/101,565

(22) Filed: Apr. 8, 2005

(65) Prior Publication Data

US 2006/0178229 A1 Aug. 10, 2006

(30) Foreign Application Priority Data

Feb. 4, 2005 (TW) ..... 94202262 U

(51) Int. Cl.
*A63B 53/04* (2006.01)
*A63B 53/06* (2006.01)

(52) U.S. Cl. ..... 473/335; 473/350

(58) Field of Classification Search ..... 473/324–350
See application file for complete search history.

(56) References Cited

U.S. PATENT DOCUMENTS 4,867,458 A 9/1989 Sumikawa et al.
4,869,507 A 9/1989 Sahm
5,385,348 A 1/1995 Wargo
6,348,014 B1 * 2/2002 Chiu ..... 473/337
6,379,265 B1 4/2002 Hirakawa et al.
6,524,198 B2 2/2003 Takeda
2002/0137576 A1 9/2002 Dammen
2003/0148818 A1 8/2003 Myrhum et al.
2004/0092332 A1 5/2004 Willett et al.

FOREIGN PATENT DOCUMENTS

JP 10137374 A * 5/1998

* cited by examiner

*Primary Examiner*—Eugene Kim
*Assistant Examiner*—Alvin A Hunter
(74) *Attorney, Agent, or Firm*—Birch, Stewart, Kolasch & Birch, LLP

(57) ABSTRACT

A golf club head includes a body, a weight, and a positioning resilient member. The body includes an engaging seat having a perimeter wall and a perimeter groove defined in the perimeter wall. The weight is mounted in the engaging seat, and includes a main body having a perimeter wall with a plurality of latching grooves corresponding to the perimeter groove of the engaging seat. The positioning resilient member is initially mounted in the perimeter groove of the engaging seat prior to receiving the weight. The positioning resilient member includes at least one engaging point pressing against a perimeter bottom wall of the perimeter groove. The positioning resilient member is further engaged in the latching grooves of the weight to thereby resiliently retain the weight in the engaging seat when assembled.

20 Claims, 8 Drawing Sheets

WEIGHT ASSEMBLY FOR GOLF CLUB HEAD

BACKGROUND OF THE INVENTION

1. Field of the Invention

The present invention relates to a weight assembly for a golf club head. In particular, the present invention relates to a weight assembly that is detachably mounted to a golf club head.

2. Description of Related Art

Conventionally, a weight is applied to a golf club head for adjusting a center of gravity of the golf club head. The weight can be reliably fixed inside a body of the golf club head by welding, brazing, or gluing. Disadvantageously, changes in the weigh for adjusting of the center of gravity of the golf club head cannot be achieved due to a fixed relationship between the weight and the golf club head.

U.S. Patent Publication No. 2002/0137576A1 discloses a golf club head with adjustable weights, wherein at least one screw or weight is thread-engaged in a corresponding number of tubular sleeves in the club head, and a lid is fastened to the opening of each tubular sleeve for better appearance. Each weight can be mounted in the associated tubular sleeve and adjusted to a desired depth therein for determining the center of gravity of the club head, as the weight has a length smaller than that of the associated tubular sleeve.

In readjusting operation, the user must initially remove the lids and adjust the screws (weights) one by one and then resealing the lids. Further, there is a widely adjustable range of both of the lids and the weights with respect to the depths of the tubular sleeves. As a result, it is difficult to control the precise location of the center of gravity. Further, a hitting stress may loosen the screw-engagement of the screws with the golf club head during striking a golf ball, resulting in odd sounds and/or a change in the center of gravity. Further, manufacturing of the tubular sleeves, the weights, and the lids require relatively high precision, resulting in complicated manufacturing processes and difficulty.

OBJECTS OF THE INVENTION

An object of the present invention is to provide a weight assembly for a golf club head that allows easy adjustment of the center of gravity of the golf club head.

Another object of the present invention is to provide a weight assembly that can be mounted to a golf club head via a simple assembling procedure.

A further object of the present invention is to provide a weight assembly that includes a vibration-absorbing member for improving the vibration-absorbing effect.

Still another object of the present invention is to provide a weight assembly that provides a golf club head with reliable assembling effect.

Yet another object of the present invention is to provide a weight assembly for a golf club head with increased convenience to adjustment of the center of gravity.

Still another object of the present invention is to provide a weight assembly for a golf club head with more flexible adjustment of the center of gravity.

SUMMARY OF THE INVENTION

In accordance with a first aspect of the present invention, a golf club head comprises a body, a weight, and a positioning resilient member. The body includes an engaging seat having a perimeter wall. A perimeter groove is defined in the perimeter wall. The weight is mounted in the engaging seat and includes a main body having a perimeter wall with a plurality of latching grooves corresponding to the perimeter groove of the engaging seat. The positioning resilient member is initially mounted in the perimeter groove of the engaging seat prior to receiving the weight. The positioning resilient member includes at least one engaging point pressing against a perimeter bottom wall of the perimeter groove. The positioning resilient member is further engaged in the latching grooves of the weight to thereby resiliently retain the weight in the engaging seat.

In accordance with a second aspect of the present invention, a golf club head comprises a body, a weight, a positioning resilient member, and an unlatching member. The body includes an engaging seat having a perimeter wall. A perimeter groove is defined in the perimeter wall. The weight is mounted in the engaging seat and includes a main body having a perimeter wall with a plurality of latching grooves corresponding to the perimeter groove of the engaging seat. The positioning resilient member is initially mounted in the perimeter groove of the engaging seat prior to receiving the weight. The positioning resilient member includes at least one engaging point pressing against a perimeter bottom wall of the perimeter groove. The positioning resilient member is further engaged in the latching grooves of the weight to thereby resiliently retain the weight in the engaging seat when assembled. The unlatching member includes a plurality of unlatching rods. Each unlatching rod can be inserted into an associated one of the unlatching holes of the weight in attempting to expand the positioning resilient member radially outward, thereby allowing removal of the weight from the engaging seat.

Preferably, each unlatching rod includes an inclined face on a distal end thereof for pushing the positioning resilient member radially outward, thereby disengaging the positioning resilient member from the latching grooves of the weight and allowing removal of the weight.

In an embodiment of the invention, the engaging seat includes a bottom wall, and a vibration-absorbing member is mounted between the bottom wall of the engaging seat and the weight.

In another embodiment of the invention, the engaging seat includes a bottom wall from which an extension extends longitudinally inward. The weight includes a shank that extends from the main body and that is received in the extension of the engaging seat. The extension of the engaging seat includes an opened or closed bottom end. A vibration-absorbing member may be mounted to the closed bottom end of the extension. In an embodiment, the shank of the weight includes a plurality of sections having different lengths. In another embodiment, the shank of the weight includes a plurality of sections having different specific densities.

Preferably, the main body of the weight includes a plurality of longitudinal unlatching holes extending from a first side of the main body through a second side of the main body. Each longitudinal unlatching hole is in communication with an associated one of the latching grooves of the main body, forming a cruciform groove.

Preferably, the engaging seat includes an opening that is triangular, rhombic, or polygonal, and the main body of the weight has a shape corresponding to that of the opening of the engaging seat.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
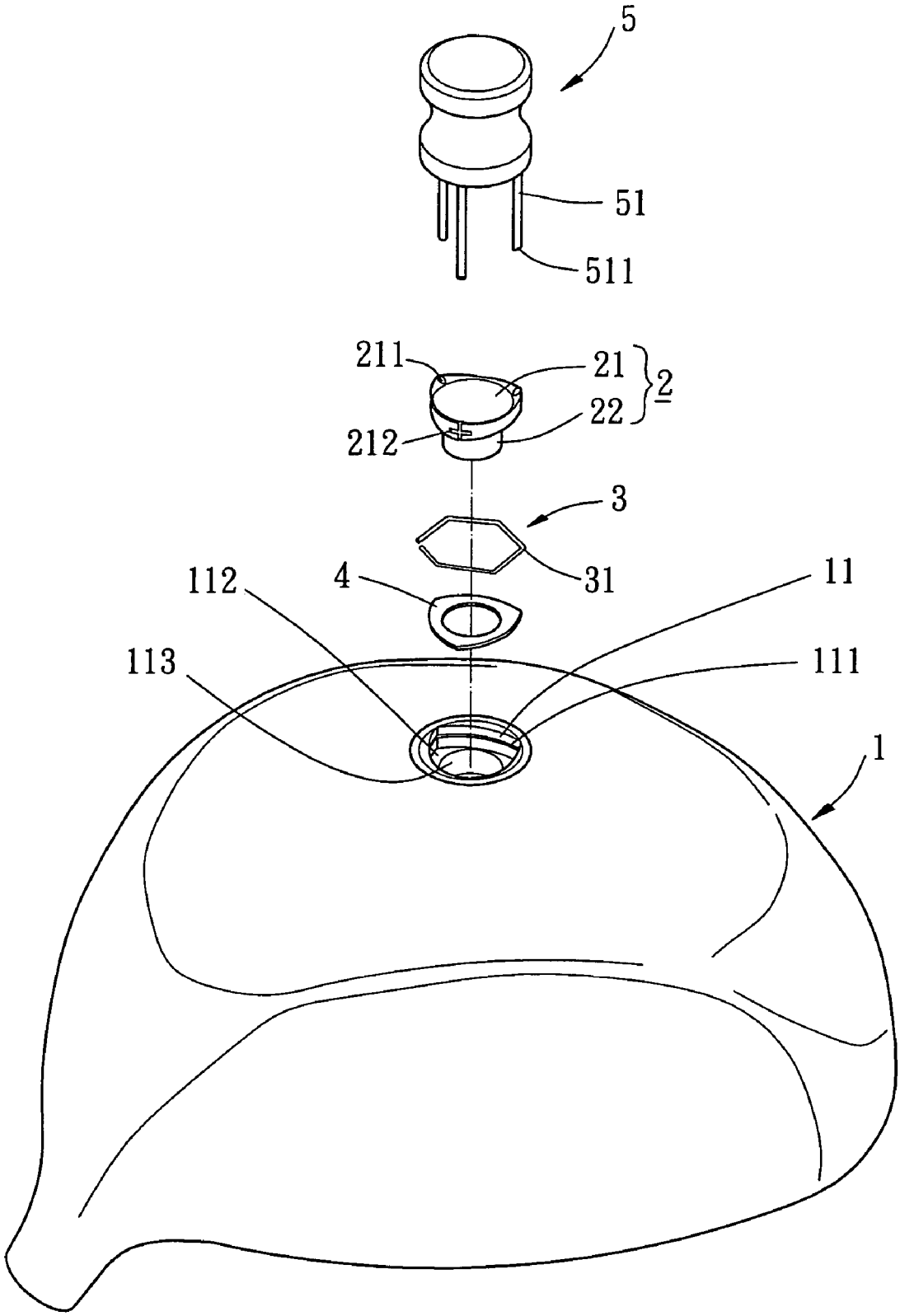
FIG. 1 is an exploded perspective view of a golf club head with a first embodiment of a weight assembly in accordance with the present invention.
Figure 2:
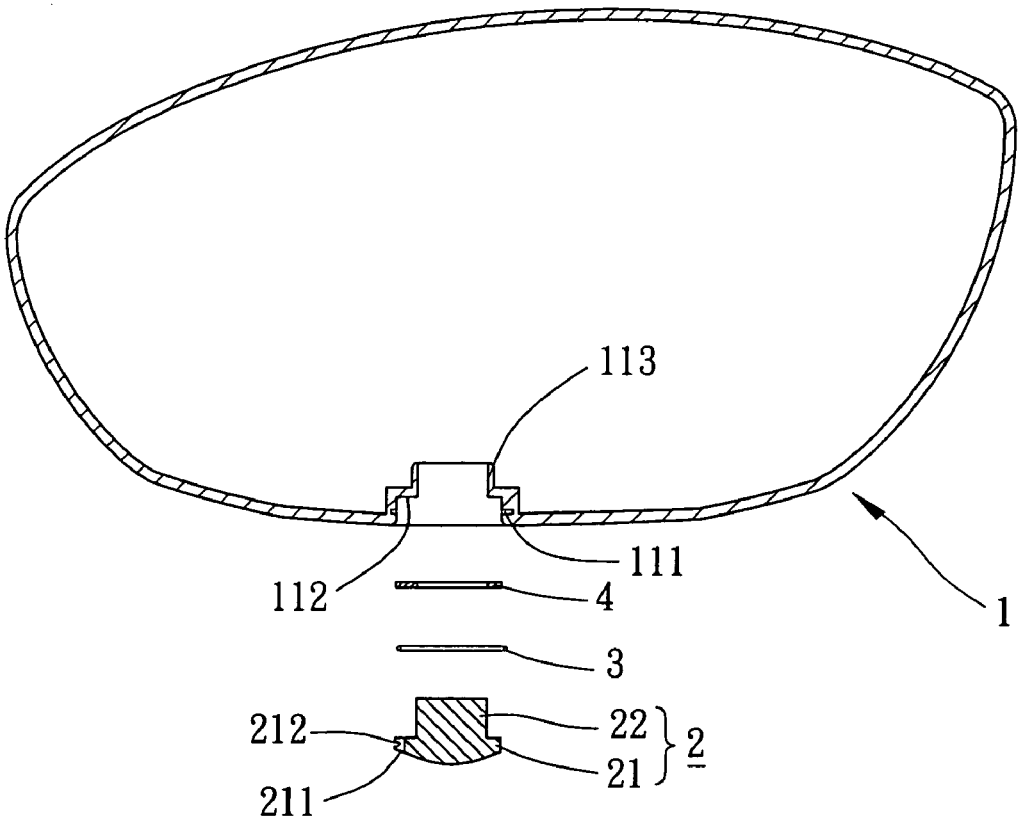
FIG. 2 is an exploded sectional view of the golf club head in FIG. 1.
Figure 3:
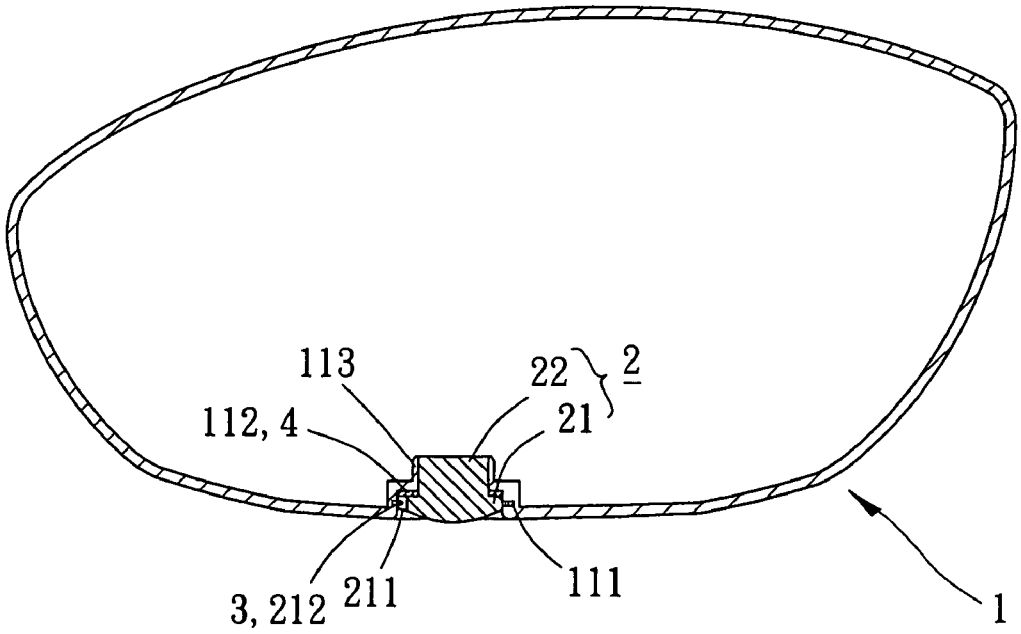
FIG. 3 is a sectional view of the golf club head.

FIG. 1 shows a golf club head with a first embodiment of a weight assembly in accordance with the present invention. FIG. 2 is an exploded sectional view of the golf club head in FIG. 1. FIG. 3 is a sectional view of the golf club head.

The golf club head comprises a body 1, a weight 2, a positioning resilient member 3, and a vibration-absorbing member 4. The weight 2 can be mounted to and fastened in the body 1 in assembling operation, or unfastened and detached from the body 1 by an unlatching member 5 in disassembling operation. The body 1 is made of stainless steel, carbon steel, alloy steel, Fe—Mn—Al alloy, or carbon fiber by casting, forging, or mechanical processing. In the illustrated embodiment, the body 1 is of a wood type club head. Detail description of the body 1 is omitted to avoid redundancy.

The body 1 includes an engaging seat 11 in a sole thereof. The engaging seat 11 is preferably a recessed portion adjacent to a rear of the body 1. Preferably, the engaging seat 11 includes an opening that has a symmetric shape, such as triangular, square, rhombic, polygonal (such as pentagonal), or of other symmetric shape. The engaging seat 11 includes a perimeter wall delimiting a space for accommodating the weight 2, with a perimeter groove 111 being defined in the perimeter wall. Further, the engaging seat 11 includes an extension 113 extending longitudinally inward from a bottom wall 112 of the engaging seat 11 into the body 1. Preferably, the extension 113 is cylindrical and has an opened bottom end.

The weight 2 is made of a metal material the same as or different from that of the body 1. Preferably, the weight 2 is made of tungsten, iron, nickel, titanium, copper, or a combination thereof. The weight 2 includes a main body 21 and a shank 22 extending from the main body 21. The main body 21 has a shape corresponding to that of the opening of the engaging seat 11. Preferably, the main body 21 is triangular, square, rhombic, polygonal (such as pentagonal), or of other symmetric shape.

The main body 21 includes a perimeter wall on which a plurality of latching grooves 212 are defined. Further, the main body 21 includes a plurality of longitudinal unlatching holes 211 extending from a first side of the main body 21 through a second side of the main body 21 that is opposite to the first side of the main body 21. Each unlatching hole 21 is in communication with the associated the latching groove 212, so that the combination of the unlatching hole 21 and the latching groove 212 commonly forms a substantially cruciform groove (see FIG. 1). Preferably, the unlatching holes 211 are respectively defined in a plurality of corners of the main body 2.

The shank 22 has a shape corresponding to that of the extension 113 of the engaging seat 11, such as cylindrical. The shank 22 has a predetermined length according to the need of adjustment of the center of gravity and moment of inertia.

In the embodiment illustrated in FIGS. 1 and 2, the positioning resilient member 3 is formed of a metal wire by pressing. The positioning resilient member 3 is polygonal, such as hexagonal, triangular, etc. Thus, the positioning resilient member 3 includes a plurality of engaging points 31 that press against a perimeter bottom wall of the perimeter groove 111 for engagement while the positioning resilient member 3 provides with deformability.

The vibration-absorbing member 4 has a predetermined thickness and is made of a vibration-absorbing material, such as rubber. The vibration-absorbing member 4 is mounted between the bottom wall 112 of the engaging seat 11 and the weight member 2 to provide a vibration-absorbing effect. Preferably, the vibration-absorbing member 4 has a central hole through which the shank 22 of the weight 2 extends into the extension 113 of the engaging seat 11 for creating an assembled relationship.

Still referring to FIGS. 1 and 2, the weight 2 can be mounted to and fastened in the body 1 by engaging with the positioning resilient member 3 in assembling operation. Alternatively, the weight 2 can be unfastened and detached from the engaging seat 11 by the unlatching member 5 disengaging it from the positioning resilient member 3 in disassembling operation. The unlatching member 5 includes a plurality of unlatching legs 51 each having an inclined face 511 (FIG. 4A) on a distal end thereof. Each unlatching leg 51 is inserted into an associated unlatching hole 211 of the weight 2 and urges the positioning resilient member 3 in the perimeter groove 212 to expand radially outward, thereby allowing removal of the weight 2 from the engaging seat.

In assembly, as illustrated in FIGS. 2 and 3, the vibration-absorbing member 4 is initially disposed on the bottom wall 112 of the engaging seat 11, and the engaging points 31 of the positioning resilient member 3 are then received in the perimeter groove 111 of the engaging seat 11. The vibration-absorbing member 4 is retained in place by protruded sections of the positioning resilient member 3 outside the perimeter groove 111. In an alternative embodiment, the positioning resilient member 3 cannot retain the vibration-absorbing member 4. Next, the weight 2 is mounted into the engaging seat 11, with an end face of the shank 21 pushing the positioning resilient member 3 radially outward until the positioning resilient member 3 is engaged in the latching grooves 212 of the main body 21. In a case that the positioning resilient member 3 cannot perform sufficient deformability, the unlatching member 5 can be used to facilitate assembly of the weight member 2 and the positioning resilient member 3.

Thus, the weight 2 can be rapidly and reliably mounted in the engaging seat 11 for adjusting the center of gravity of the golf club head. Further, the vibration-absorbing member 4 can also be mounted in the engaging seat 11 for providing a vibration-absorbing effect to thereby avoid generating odd sounds. In the illustrated embodiment, the positioning resilient member 3 can advantageously prevent from falling off the weight 2 and the vibration-absorbing member 4 from the engaging seat 11 during striking a golf ball. Since the opening of the engaging seat 11 and the main body 21 are not circular, rotational movement of the weight 2 about the engaging seat 11 is prevented, further improving the positioning effect for the weight 2.

Figure 4:
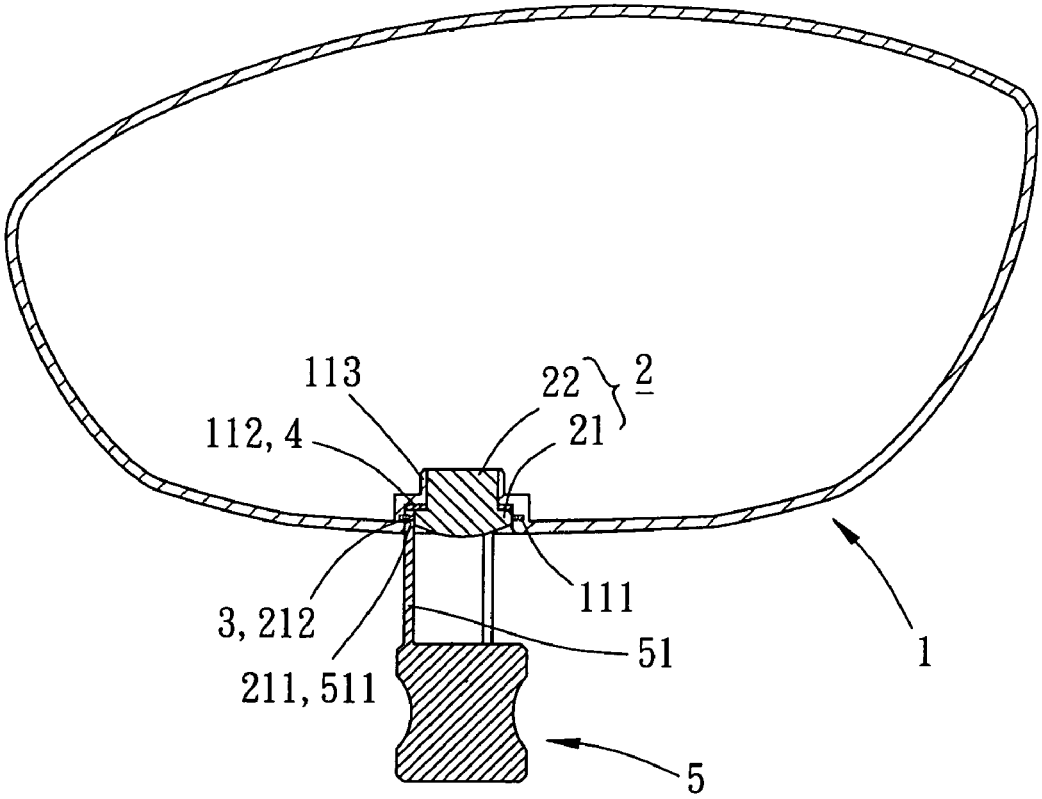
FIG. 4 is a sectional view similar to FIG. 3, illustrating detachment of the weight assembly from the golf club head.
Figure 4A:
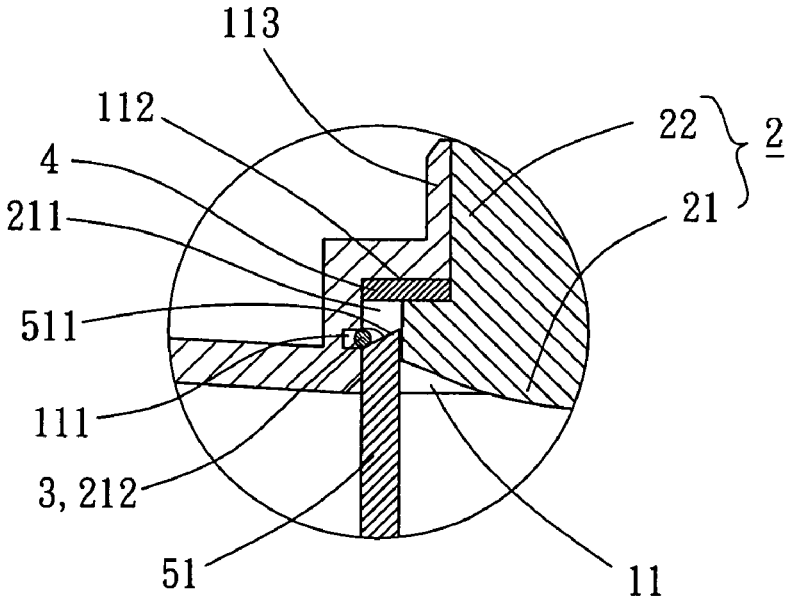
FIG. 4A is an enlarged view of a portion of the golf club head in FIG. 4.

Referring to FIGS. 3, 4, and 4A, when removal of the weight 2 is required, each unlatching leg 51 of the unlatching member 5 is inserted and slid into an associated unlatching hole 211 of the main body 21 of the weight 2 in disassembling operation. The inclined face 511 on the distal end of each unlatching leg 51 pushes the positioning resilient member 3 radially outward until the positioning resilient member 3 is disengaged from the latching grooves 212 of the weight 2. In this case, this results in permission from the positioning resilient member 3 to draw out the weight 2 from the engaging seat 11 by gravity. Desired weight of a different mass can be mounted into the engaging seat 11 in a manner mentioned above. Thus, rapid detachment and replacement of the weight 2 can be achieved.

Figure 5:
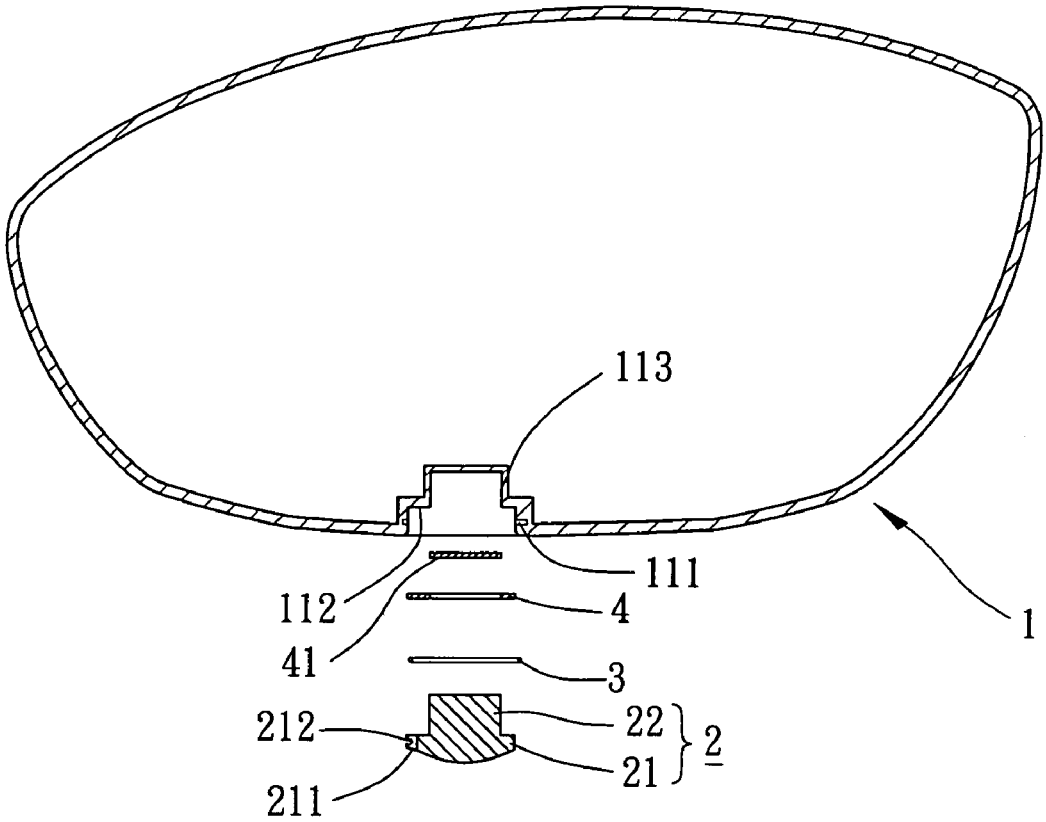
FIG. 5 is an exploded sectional view of a golf club head with a second embodiment of the weight assembly in accordance with the present invention.

FIG. 5 shows a second embodiment of the present invention, wherein the extension 113 has a closed bottom end. Further, another vibration-absorbing member 41 is mounted to the closed bottom end of the extension 113 and in contact with the shank 22 of the weight 2. Accordingly, an installation space for the vibration-absorbing member 4 and an interactive area between the engaging seat 11 and the vibration-absorbing member 41 can be increased that may enhance vibration-absorbing effect. Furthermore, the full engagement of the shank 22 of the weight 2 with the vibration-absorbing member 41 results in an increase of the engagement of the weight 2 with the engaging seat 11.

Figure 6:
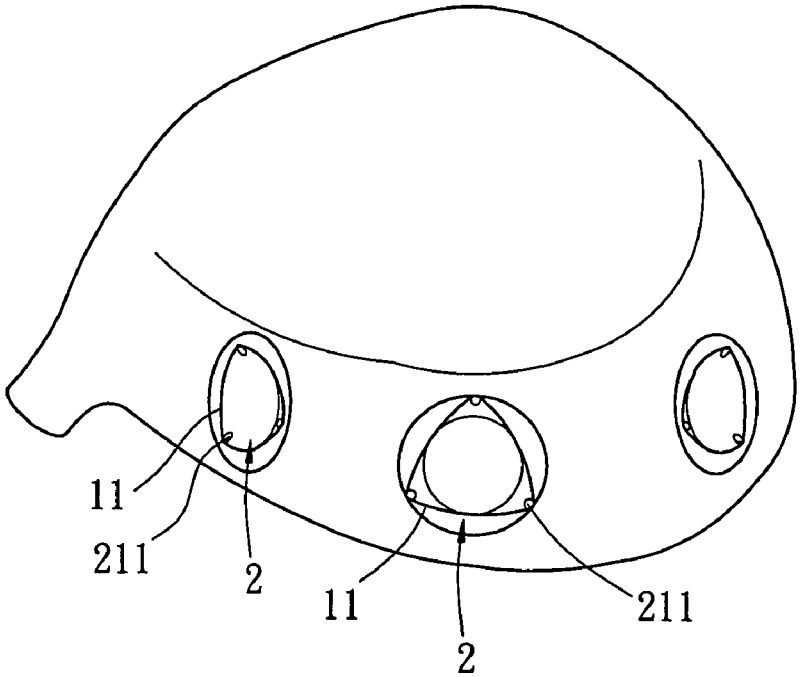
FIG. 6 is a perspective view of a golf club head with a third embodiment of the weight assembly in accordance with the present invention.

FIG. 6 shows a third embodiment of the present invention, wherein a plurality of engaging seats 11 are defined in the sole or other portions of the body 1. Each engaging seat 11 receives a weight assembly including a weight 2, a positioning resilient member 3, and a vibration-absorbing member 4 described above. The engaging seats 11 can be formed on the skirt of the body 1 and selectively located adjacent to the rear, toe, or heel of the body 1. The weights 2 may have the same mass or different masses to allow selection by the user. It will be understood that adjustment of the center of gravity for the golf club head is more flexible. In an alternative embodiment, the embodiment of FIG. 5 can be used with the structure in FIG. 6 to improve the vibration-absorbing effect and the engaging reliability of the weight 2.

Figure 7:
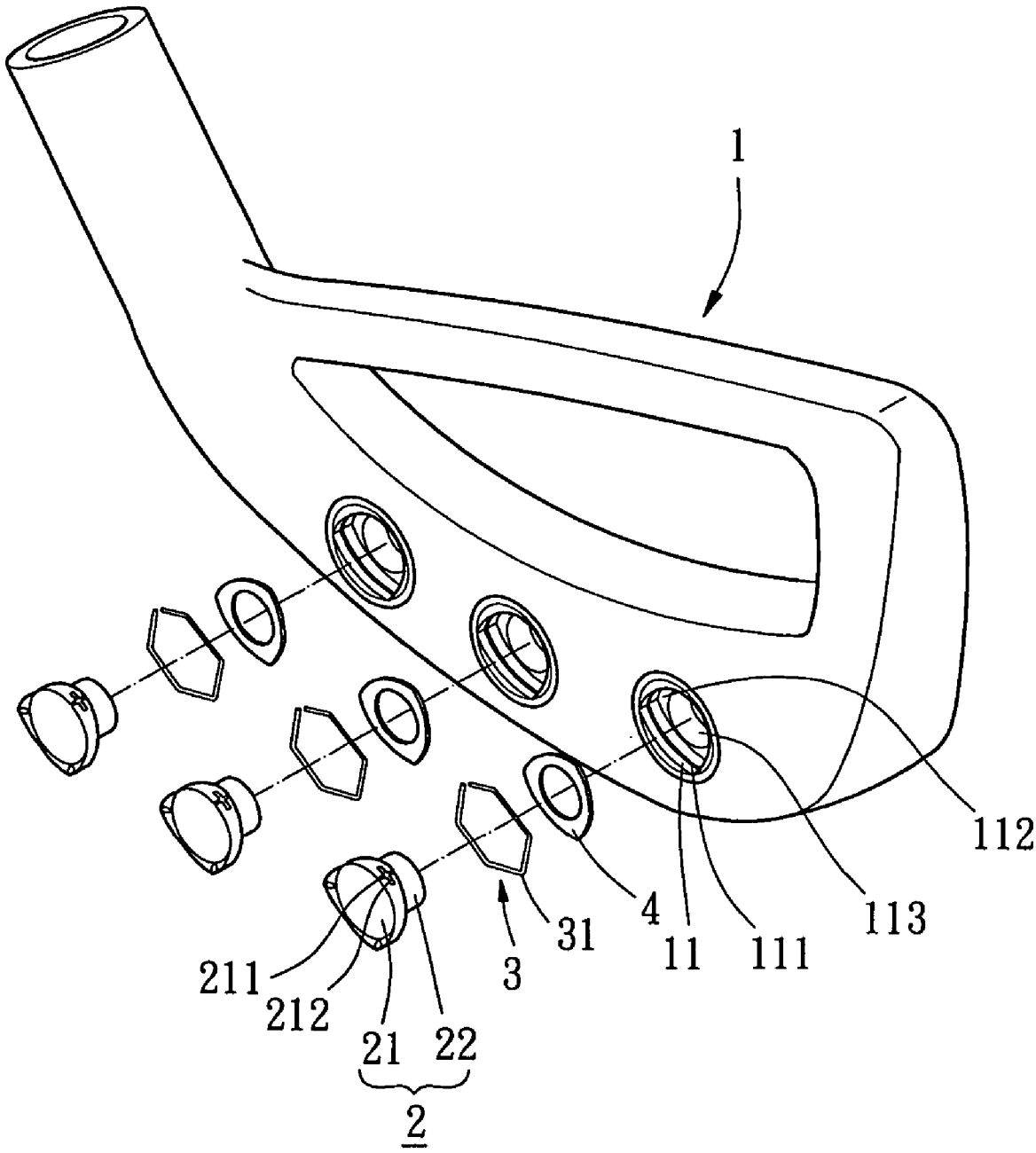
FIG. 7 is an exploded perspective view of a golf club head with a fourth embodiment of the weight assembly in accordance with the present invention.
Figure 8:
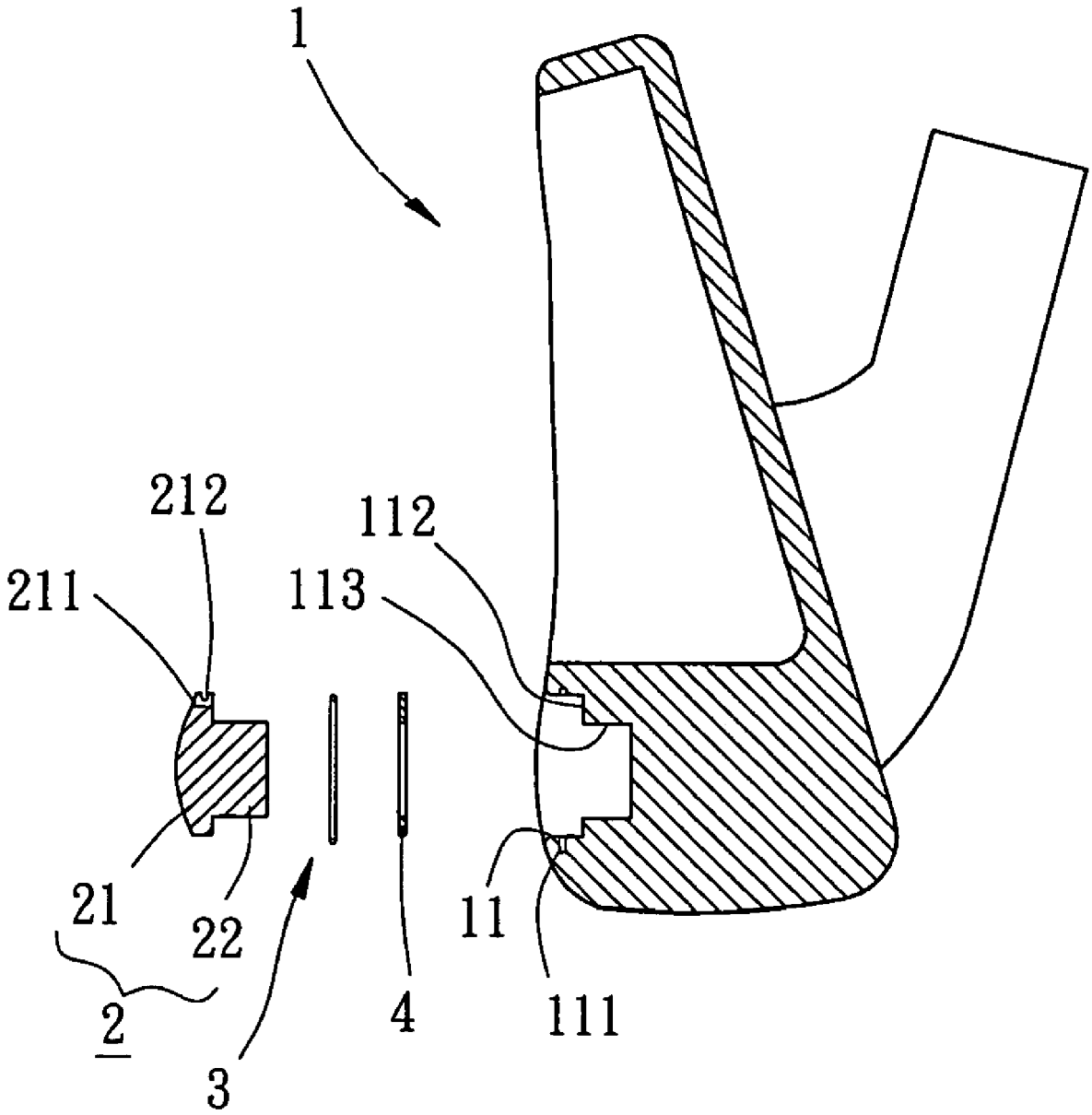
FIG. 8 is an exploded sectional view of the golf club head in FIG. 7.

FIGS. 7 and 8 show a fourth embodiment of the present invention, wherein the body 1 is of iron type club head. Further, a plurality of engaging seats 11 are provided on a lower portion of a rear side of the body 1. Each engaging seat 11 has a structure the same as that of the first embodiment. Again, the weights 2 may have the same mass or different masses to allow selection by the user. It will be understood that adjustment of the center of gravity for the golf club head is more flexible. In an alternative embodiment, the embodiment of FIG. 5 can be used with the structure of this embodiment to improve the vibration-absorbing effect and the engaging reliability of the weight 2.

Figure 10:
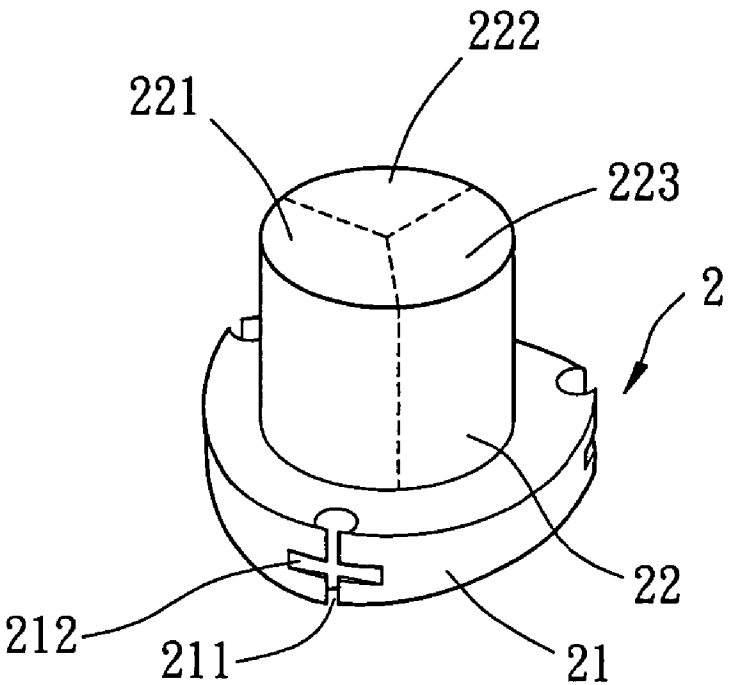
FIG. 10 is a perspective view illustrating another modified embodiment of the weight of the weight assembly in accordance with the present invention.
Figure 9:
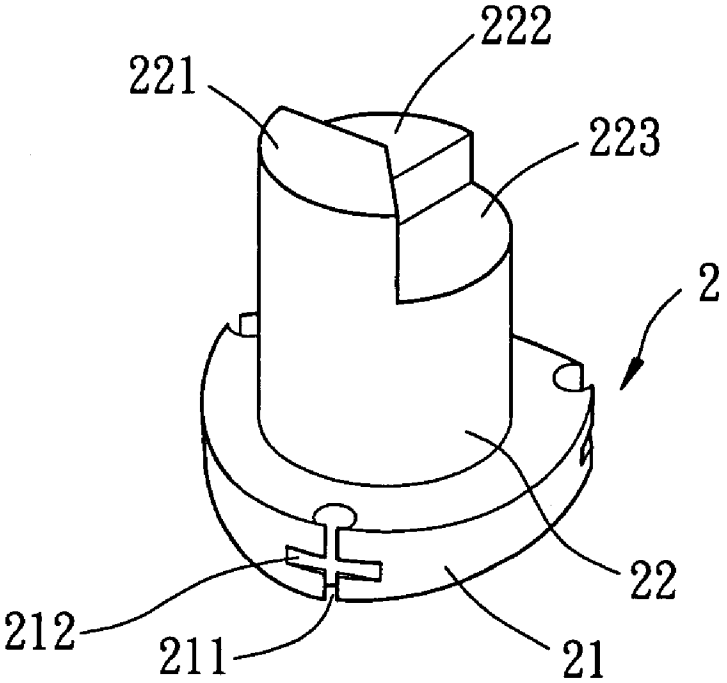
FIG. 9 is a perspective view illustrating a modified embodiment of a weight of the weight assembly in accordance with the present invention.

FIG. 9 shows a modified embodiment of the weight 2, wherein the shank 22 includes a plurality of sections 221, 222, and 223 having different lengths in varying weights. FIG. 10 shows another modified embodiment of the weight 2, wherein the shank. 22 includes a plurality of sections 221, 222, and 223 having different specific densities in varying weights. Thus, a different adjusting effect in the center of gravity can be varied by locating the weight 2 in various orientations with respect to the engaging seat 11. It will be understood that the adjusting flexibility for the golf club head is improved.

Figure 11A:
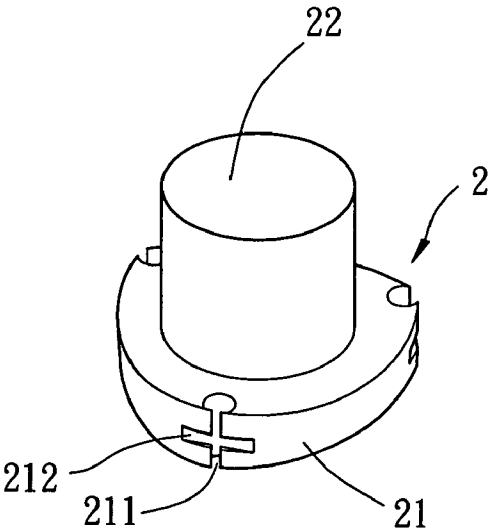
FIG. 11*a* is a perspective view illustrating a further modified embodiment of the weight of the weight assembly in accordance with the present invention.
Figure 11B:
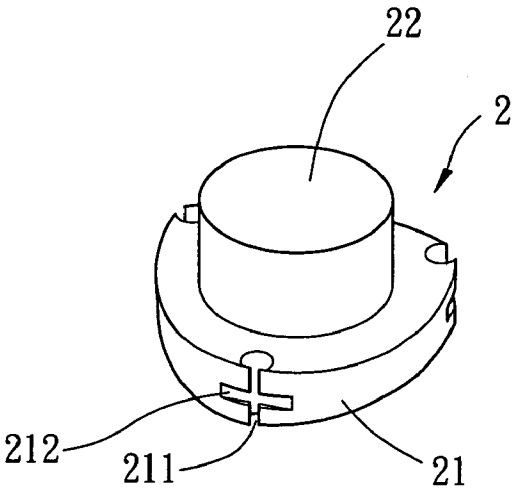
FIG. 11*b* is a perspective view illustrating still another modified embodiment of the weight of the weight assembly in accordance with the present invention.
Figure 11C:
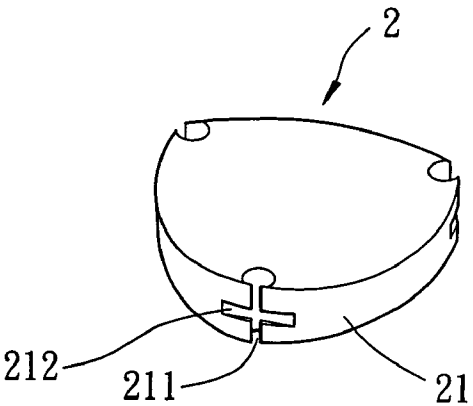
FIG. 11*c* is a perspective view illustrating yet another modified embodiment of the weight of the weight assembly in accordance with the present invention.

FIGS. 11*a*, 11*b*, and 11*c* show other modified embodiments of the weight. The shanks 22 of the weights 2 in FIGS. 11*a* and 11*b* have different lengths in varying weights, whereas the weight 2 in FIG. 11*c* has no shank portion for simplifying the entire structure, and thus the extension 113 of the engaging seat 11 can be omitted. The adjusting flexibility for the golf club head is improved.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A golf club head comprising:

a body including an engaging seat having a perimeter wall, a perimeter groove being defined in the perimeter wall; a weight mounted in the engaging seat, the weight including a main body having a perimeter wall with a plurality of latching grooves corresponding to the perimeter groove of the engaging seat, wherein the main body of the weight includes a plurality of longitudinal unlatching holes extending from a first side of the main body through a second side of the main body, each said longitudinal unlatching hole being in communication with an associated one of the latching grooves of the main body, so that the combination of the longitudinal unlatching hole and the latching groove commonly forming a cruciform groove; and a positioning resilient member mounted in the perimeter groove, the positioning resilient member including at least one engaging point pressing against a perimeter bottom wall of the perimeter groove of the engaging seat such that the positioning resilient member being received in the engaging seat, the positioning resilient member being further engaged in the latching grooves of the weight to thereby resiliently retain the weight in the engaging seat when assembled.

2. The golf club head as claimed in claim 1, wherein the engaging seat further including a bottom wall, and the golf club head further comprising a vibration-absorbing member mounted between the bottom wall of the engaging seat and the weight.

3. The golf club head as claimed in claim 1, wherein the engaging seat further includes a bottom wall and an extension extending longitudinally inward from the bottom wall, and the weight includes a shank extending from the main body, so that the shank is received in the extension of the engaging seat when assembled.

4. The golf club head as claimed in claim 1, wherein the extension of the engaging seat including an opened bottom end.

5. The golf club head as claimed in claim 1, wherein the extension of the engaging seat including a closed bottom end.

6. The golf club head as claimed in claim 5, further comprising a vibration-absorbing member mounted to the closed bottom end of the extension.

7. The golf club head as claimed in claim 1, wherein the shank of the weight including a plurality of sections having different lengths in varying weights.

8. The golf club head as claimed in claim 1, wherein the shank of the weight including a plurality of sections having different specific densities in varying weights.

9. The golf club head as claimed in claim 1, wherein the engaging seat including an opening that is polygonal, and wherein the main body of the weight having a shape corresponding to that of the opening of the engaging seat.

10. A golf club head comprising:

a body including an engaging seat having a perimeter wall, a perimeter groove being defined in the perimeter wall;

a weight mounted in the engaging seat, the weight including a main body having a perimeter wall with a plurality of latching grooves corresponding to the perimeter groove of the engaging seat;

a positioning resilient member mounted in the perimeter groove, the positioning resilient member including at least one engaging point pressing against a perimeter bottom wall of the perimeter groove of the engaging seat such that the positioning resilient member being received in the engaging seat, the positioning resilient member being further engaged in the latching grooves of the weight to thereby resiliently retain the weight in the engaging seat when assembled; and an unlatching member including a plurality of unlatching rods, each said unlatching rod being inserted and slid into an associated one of the unlatching holes of the weight to expand the positioning resilient member radially outward, thereby allowing removal of the weight from the engaging seat.

11. The golf club head as claimed in claim 10, wherein each said unlatching rod includes an inclined face on a distal end thereof for pushing the positioning resilient member in disassembling operation.

12. The golf club head as claimed in claim 10, wherein the engaging seat including a bottom wall, and the golf club head further comprising a vibration-absorbing member mounted between the bottom wall of the engaging seat and the weight.

13. The golf club head as claimed in claim 10, wherein the engaging seat including a bottom wall and an extension extending longitudinally inward from the bottom wall, and the weight including a shank extending from the main body, so that the shank being received in the extension of the engaging seat when assembled.

14. The golf club head as claimed in claim 13, wherein the extension of the engaging seat including an opened bottom end.

15. The golf club head as claimed in claim 13, wherein the extension of the engaging seat including a closed bottom end.

16. The golf club head as claimed in claim 15, further comprising a vibration-absorbing member mounted to the closed bottom end of the extension.

17. The golf club bead as claimed in claim 13, wherein the shank of the weight including a plurality of sections having different lengths in varying weights.

18. The golf club head as claimed in claim 13, wherein the shank of the weight including a plurality of sections having different specific densities in varying weights.

19. The golf club head as claimed in claim 10, wherein the main, body of the weight including a plurality of longitudinal unlatching holes extending from a first side of the main body through a second side of the main body, each said longitudinal unlatching hole being in communication with an associated one of the latching grooves of the main body, so that the combination of the longitudinal unlatching hole and the latching groove commonly forming a cruciform groove.

20. The golf club head as claimed in claim 10, wherein the engaging seat including an opening that is polygonal, and wherein the main body of the weight having a shape corresponding to that of the opening of the engaging seat.

* * * * *